US005611097A

United States Patent [19]

Dumke

[11] Patent Number: 5,611,097

[45] Date of Patent: Mar. 18, 1997

[54] FOOT STOP FOR BEDS

[76] Inventor: Dan Dumke, Rte. 2, Box 118, Markesan, Wis. 53946

[21] Appl. No.: 516,378

[22] Filed: Aug. 17, 1995

[51] Int. Cl.[6] ..... A47C 20/00; A47C 20/12; A47C 21/00

[52] U.S. Cl. ..... 5/651; 5/648; 5/503.1; 5/507.1

[58] Field of Search ..... 5/503.1, 504.1, 5/505.1, 506.1, 507.1, 648, 649, 650, 651

[56] References Cited

U.S. PATENT DOCUMENTS

| | | | |
|---|---|---|---|
| 931,908 | 8/1909 | Weld | 5/651 |
| 1,539,082 | 5/1925 | Fyler | 5/651 |

FOREIGN PATENT DOCUMENTS

| | | | |
|---|---|---|---|
| 0074680 | 9/1952 | Denmark | 5/651 |
| 0019041 | 9/1909 | United Kingdom | 5/651 |
| 0023697 | 10/1911 | United Kingdom | 5/648 |
| 0005105 | 7/1913 | United Kingdom | 5/651 |

*Primary Examiner*—Steven N. Meyers
*Assistant Examiner*—Robert G. Santos
*Attorney, Agent, or Firm*—Donald Cayen

[57] ABSTRACT

A foot stop is used by a bedridden patient to resist the tendency of sliding toward the foot of the bed. The foot stop comprises a first plate that is contactable by the patient's feet, a second plate that is placed against the foot portion of the bed frame, and bars that hold the two plates apart. By pushing on the first plate with his feet, the patient can maintain a desired position in the bed without help. The length of the bars can be adjustable to suit different height patients.

3 Claims, 2 Drawing Sheets

FIG. 3
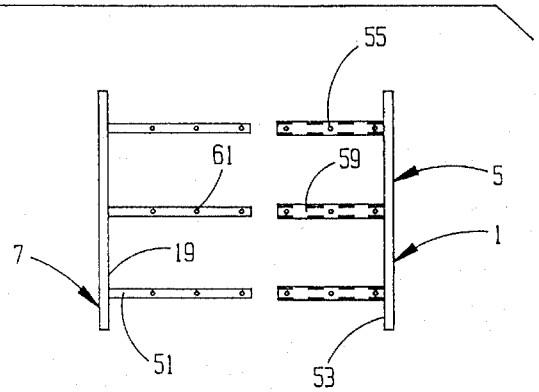
FIG. 4
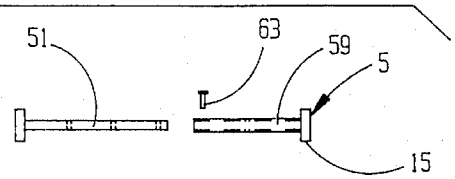
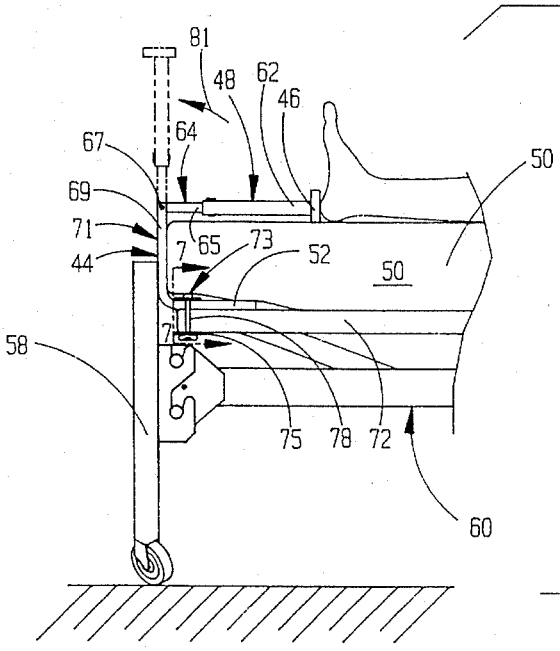
FIG. 6
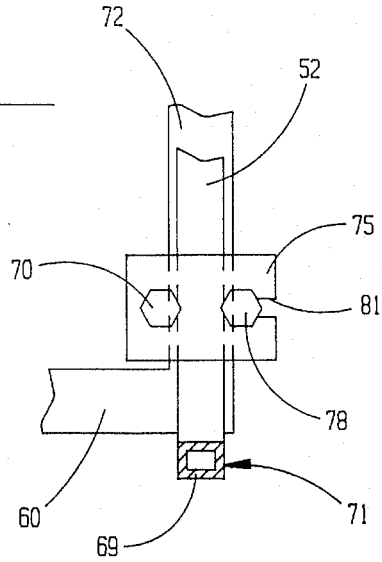
FIG. 8
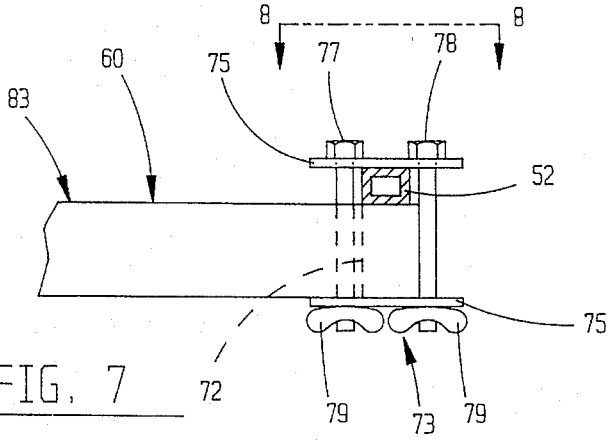
FIG. 7

FOOT STOP FOR BEDS

BACKGROUND OF THE INVENTION

1. Field of the Invention

This invention pertains to invalid care, and more particularly to apparatus that enhances the comfort of bedridden patients.

2. Description of the Prior Art

Articulated hospital beds are well known and are in everyday use. Such beds enable a patient to selectively recline flat or to sit up at varying angles.

Although a patient is normally comfortable when sitting up, a problem arises in that situation. The problem has to do with the tendency of the patient to slide toward the foot of the bed. Even with very slight angles of tilt of the bed such that the patient is almost flat, the patient tends to gradually slide toward the foot of the bed. That situation is aggravating, and it distracts the patient at a time when his mind should be at ease.

To reposition the patient, two nurses or other attendants are usually required to pull the patient by under his arms. That action is potentially harmful, and it is a source of worry to the patient. Further, repositioning the patient is often a low priority task for the nurses or other attendants, so the patient must sometimes wait to be repositioned.

Thus, a need exists for a way to keep a patient at a desired position within a bed.

SUMMARY OF THE INVENTION

In accordance with the present invention, a foot stop is provided that enables a bedridden person to remain at a predetermined position within the bed. This is accomplished by apparatus that includes a first plate that is contactable by the person's feet and a second plate that abuts a portion of the bed frame.

The first and second plates have respective lengths that are less than the width of the bed mattress. Each plate has opposed front and back surfaces and top and bottom edges. The plates are parallel to each other and are separated at variable distances by two or more bars. The bars are joined to and extend between the first plate back surface and the second plate front surface. The top edges of the two plates are generally coplanar. The width of the second plate varies to suit the particular bed. For a bed with a frame in which the foot portion thereof rises higher than the mattress top surface, the second plate has generally the same width as the first plate. For a bed in which the foot portion of the frame is below the mattress top surface, the second plate is considerably wider than the first plate.

To vary the distance between the first and second plates, each of the bars is in two pieces. One piece is a tube joined to one of the plates. The second piece is a rod that is joined to the other piece and that is slidable inside an associated tube. Several transverse holes through the rods and tubes are alignable at different spacings between the plates. Pins inserted through aligned holes in the rods and tubes maintain the two plates at a desired distance from each other that is suitable for the patient's height.

In use, a foot stop having a second plate with a width appropriate to the particular bed is chosen. The bottom edge of the first plate is placed on the mattress lower sheet. The second plate is placed against the foot portion of the bed frame. The distance between the plates is adjusted to the patient's height, and the pins are inserted through the appropriate holes in the rods and tubes. The patient in the bed can place his feet against the first plate. By pushing occasionally with his legs and feet, the patient can remain at a desired position within the bed for all angles of bed tilt.

In a modified embodiment, the second plate is eliminated, and each bar has three pieces. The first piece is a tube joined to the first plate. The second piece is a rod having a first end that is slidable inside an associated tube. The third piece is an L-shaped piece. The end of one leg of the L-shaped piece is hinged to the second end of the rod. The L-shaped piece wraps around and under the foot of the mattress. A clamp associated with each third piece holds its second leg to the bed frame under the mattress.

The modified foot stop is used by placing the first leg of the L-shaped piece against the foot portion of the bed frame. The foot stop remains with the mattress when the foot end of the bed is tilted upwardly. The hinged connections between the rods and the L-shaped pieces enable the mattress sheet to be easily removed from and put back on the mattress.

The method and apparatus of the invention, using a plate that is in contact with a patient's foot and is retained by the bed frame, thus enables the patient to maintain his position within the bed. The prior chore of periodically pulling a patient by his arms back toward the head of the bed is eliminated.

Other advantages, benefits, and features of the present invention will become apparent to those skilled in the art upon reading the detailed description of the invention.

BRIEF DESCRIPTION OF THE DRAWINGS

FIG. 3 is an exploded top view of the invention.

FIG. 4 is a side view of FIG. 3.

FIG. 6 is a side view of a modified embodiment of the invention.

FIG. 7 is a cross section view on an enlarged scale taken along line 7—7 of FIG. 6.

FIG. 8 is a view taken along line 8—8 of FIG. 7.

DETAILED DESCRIPTION OF THE PREFERRED EMBODIMENT

Figure 1:
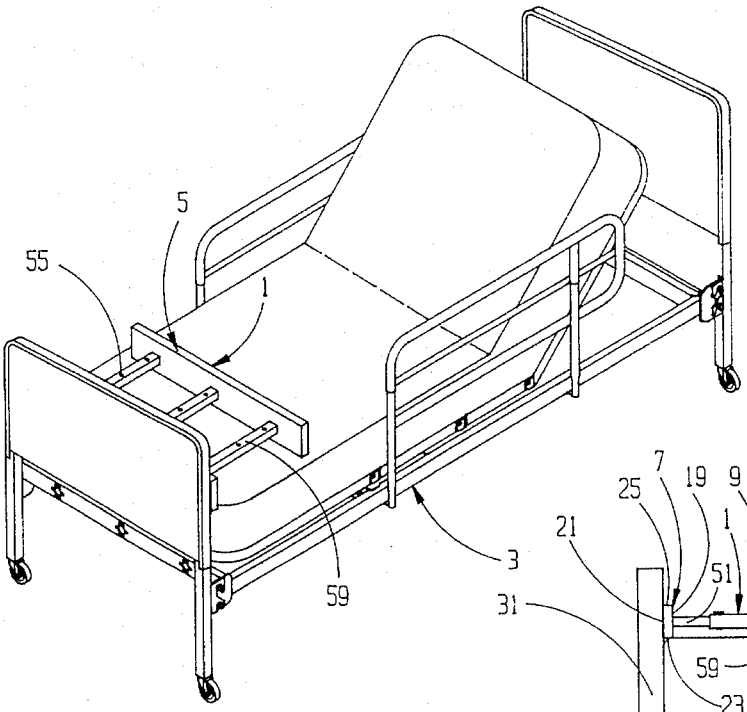
FIG. 1 is a perspective view of the present invention in place on a hospital bed.
Figure 2:
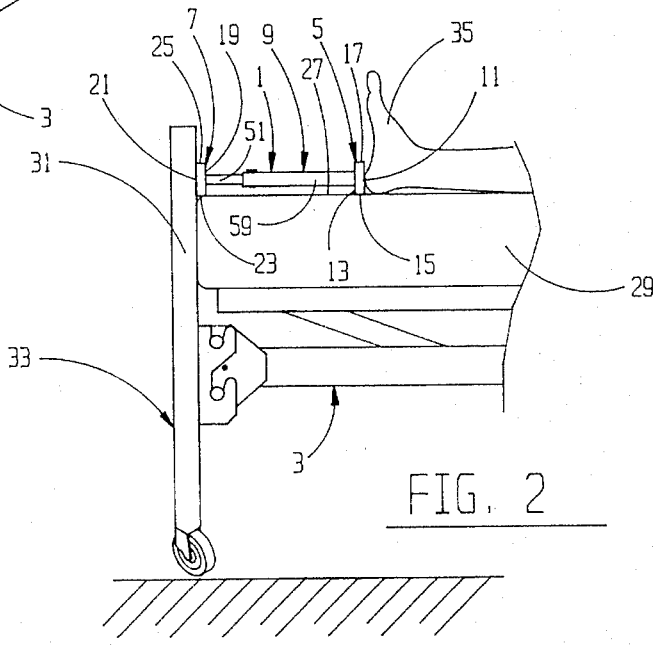
FIG. 2 is a side view of the invention.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring to FIGS. 1–4, a foot stop 1 is illustrated that includes the present invention. The foot stop 1 is particularly useful to patients in a hospital bed 3, but it will be understood that the invention is not limited to medically related applications.

The foot stop 1 is comprised of a foot plate 5, a back plate 7, and a number of bars 9. The foot plate 5 has a front surface 11, a back surface 13, a bottom edge 15, and a top edge 17. The foot plate front surface 11 is preferably covered with a layer of soft material such as rubber or cloth. The back plate 7 has a front surface 19, a back surface 21, a bottom edge 23, and a top edge 25.

The bars 9 are joined to the foot plate back surface 13 and to the back plate front surface 19 such that those two surfaces are parallel. The top edges 17 and 25 of the foot and back plates 5 and 7, respectively, are preferably generally coplanar. The bottom edges 15 and 23 of the two plates are also coplanar.

To vary the distance between the foot and back plates 5 and 7, respectively, each bar 9 is comprised of a rod 51 and a tube 59. Preferably, the rods 51 are joined to the back plate, and the tubes 59 are joined to the front plate. Several holes 55 are formed in each tube. The holes 55 are preferably perpendicular to the plane of the bottom edge 15 of the foot plate. A rod 51 is joined to and extends from the front surface 19 of the back plate in operative association with each tube 59. The rods are located and sized such that they easily slide inside the tubes. At least one and preferably several holes 61 are formed in each rod.

The foot stop 1 is used by placing it on the bed sheet, not shown, that covers the top surface 27 of the mattress 29. Specifically, the bottom edges 15 and 23 of the foot and back plates 5 and 7, respectively, are placed on the mattress bottom sheet. The back surface 21 of the back plate is placed against the foot portion 31 of the bed frame 33. The tubes 59 of the foot plate 5 are slid over the rods 51 of the back plane until the foot plate is at the desired location relative to the patient's feet 35. Then a pin 63 is inserted through aligned holes 55 and 61 in the tubes and associated rods. By pushing against the foot plate with his feet and legs, the patient can easily resist the tendency to slide toward the foot of the bed 3. Consequently, the patient can remain at his desired position within the bed without help from nurses or other attendants. Blankets on the bed, not illustrated in the drawings, cover the foot stop 1 without problem.

It is contemplated that foot stops 1 having three different length bars 9 will accommodate patients of all heights in the hospital bed 3. A first length of approximately three inches for the rods 51 and tubes 59 will enable the foot plate 5 to be located between approximately three inches and five inches from the foot portion 31 of the bed frame 33. That size foot stop will suit taller patients. A second length of approximately six inches for the rods and tubes will enable the foot plate to be located between approximately six inches and eleven inches from the foot portion of the bed frame. A third length of approximately twelve inches for the rods and tubes will enable the foot plate to be located between approximately twelve inches and twenty-three inches from the foot portion of the bed frame. That size will be suitable for children.

Figure 5:
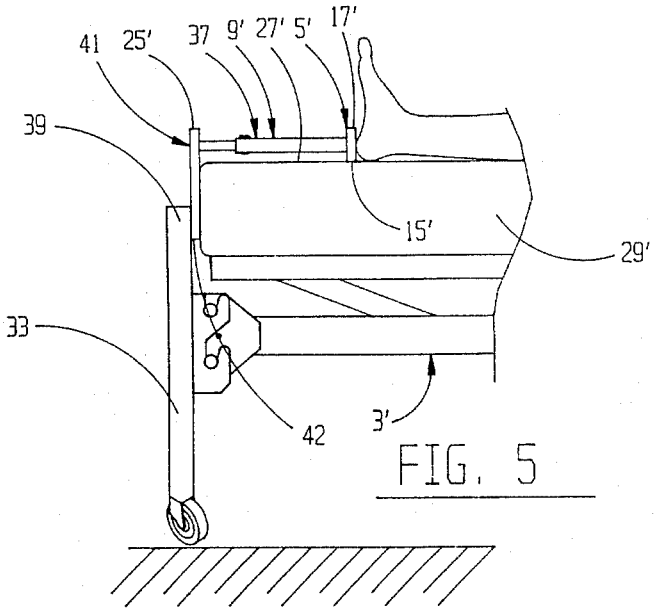
FIG. 5 is a view similar to FIG. 2, but showing an alternate form of the invention.

Now turning to FIG. 5, an alternate foot stop 37 is shown. The foot stop 37 is used with beds 3' in which the foot portion 39 of the frame 33 is below the top surface 27' of the mattress 29'. The foot stop 37 has a foot plate 5' and bars 9' that are substantially similar to the foot plate 5 and bars 9, respectively, of the foot stop 1 described previously in connection with FIGS. 1–4. However, the back plate 41 of the foot stop 37 is considerably wider than the back plate 7 of FIGS. 1–4. The back plate 41 of the foot stop 37 is wide enough to contact the frame foot portion 39. Consequently, although the top edges 17' and 25' of the foot and back plates, respectively, may be generally coplanar, the bottom edge 42 of the back plate 41 is considerably lower than the bottom edge 15' of the foot plate 5'.

FIGS. 6–8 show a modified embodiment of the present invention. The foot stop 44 of FIGS. 6 and 7 has a foot plate 46 and two bars 48. Each bar 48 is comprised of a tube 62 joined to and extending from the foot plate 46. The tube 62 has a number of pin holes therethrough. Each bar is further comprised of a rod 64 having a first end 65 that is slidable within an associated tube. The second end of the rod 64 is pivotally connected by a pin 67 to one leg 69 of an L-shaped piece 71. The L-shaped piece 71 wraps around and under the foot end of the mattress 50 and overlies a side rail 72 of the bed frame 60. The first leg 69 of the L-shaped piece abuts the foot portion 58 of the bed frame 60 at the end of the mattress 50. The second leg 52 of the L-shaped piece is held in place to the bed rail 72 under the mattress 50.

A clamp 73 retains the foot stop 44 to the bed frame 60. In the illustrated construction, the clamp 73 comprises two plates 75 and two screws 77 and 78. The plates 75 sandwich the bed rail 72 and the second leg 52 of the L-shaped piece 71 between them. The screw 77 passes between aligned holes in the plates. The screw 78 passes through aligned slots 81 in the plates. Wing nuts and washers 79 cooperate with the screws 77 and 78 to clamp the L-shaped piece to the bed frame. In that manner, the foot stop 44 remains with the mattress 50 when the foot end of the mattress is raised. The slots 81 in the plates 75 enable the foot stop 44 to be quickly and easily assembled to and removed from the bed 83.

The pivotal connections between the L-shaped pieces 71 and the rods 64 enable the rods, tubes 62, and foot plate 46 to swing in the direction of arrow 81. By raising the rods and foot plate off the mattress 50, the bed sheets can be changed without having to remove the foot stop 44 from the bed 83.

The foot stops 1, 37, and 44 may be made of any suitable material. A preferred material is a molded thermosetting plastic material. The pins 63 may be of plastic or metal. Suitable sizes for the foot and back plates are a length of approximately 36 inches, a width of approximately three inches and a thickness of approximately 0.50 inches.

In summary, the results and advantages of hospital beds can now be more fully realized. The foot stop of the invention enables patients to remain at a desired comfortable position within a tilted bed without having to worry about sliding toward the foot of the bed. This desirable result comes from using the combined functions of the foot stop plates and bars, and the foot portion of the bed frame. Force from a patient's feet and legs is transferred by the foot stop to the foot portion of the bed frame such that the patient can easily prevent himself from sliding toward the foot of the bed. The prior task of pulling a patient by under his arms back toward the head of the bed by nursing attendants is eliminated. The foot stop may be constructed to suit different height patients and different bed designs.

It will also be recognized that in addition to the superior performance of the foot stop of the invention, its design is such as to cost very little to manufacture. Consequently, hospitals, nursing homes, and similar institutions can easily justify purchase of the foot stop on the bases of patients' comfort and nursing productivity. Also, since the foot stop is of a simple and rugged construction, the need for maintenance is minimal.

Thus, it is apparent that there has been provided, in accordance with the invention, a foot stop for beds that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A foot stop for beds comprising:

a. a plate for placing on a bed mattress; and b. bar means joined to the plate for contacting the foot portion of a bed frame to enable a person in the bed to push with his feet against the plate and thereby resist the tendency of the person to slide toward the foot of the bed, wherein:

i. the plate has a predetermined length, front and back surfaces, and top and bottom edges; and ii. the bar means comprises:

a plurality of tubes joined to and extending from the back surface of the plate, each tube defining a plurality of holes therethrough;

a plurality of rods having respective first ends that are slidable within respective tubes and respective second ends;

a plurality of L-shaped pieces having respective first legs that are pivotally connected to the second ends of associated rods and respective second legs for wrapping around and under the mattress;

a pin associated with each tube for inserting through selected aligned holes in the tube and corresponding rod, and clamp means for clamping the second legs of the L-shaped pieces to the bed frame, so that the distance of the plate from the foot of the bed is variable and the foot stop remains with the mattress when the foot of the mattress is tilted.

2. In combination with a bed having a mattress and a frame with a foot portion, apparatus for aiding a person to maintain a desired position within the bed comprising:

a. a foot plate having a predetermined length, front and back surfaces, and top and bottom edges, the foot plate bottom edge resting on the mattress; and b. bar means joined to the back surface of the foot plate for contacting the foot portion of the bed frame to enable the person to push against the foot plate with his feet and thereby resist sliding in the bed toward the foot thereof, wherein the bar means comprises:

i. a plurality of tubes joined to and extending from the back surface of the foot plate, each tube defining a plurality of holes therethrough;

ii. a plurality of rods each having a first end that is slidable within an associated tube and a second end;

iii. a plurality of L-shaped pieces having respective first legs that are pivotally connected to the second ends of associated rods and respective second legs that wrap around and under the foot of the mattress;

iv. pin means for inserting through selected aligned holes in the tubes and corresponding rods; and v. clamp means for clamping the second legs of the L-shaped pieces to the bed frame, so that the distance of the foot plate from the foot of the bed is variable and the foot stop remains with the mattress when the foot of the mattress is tilted.

3. A method of retaining a person at a desired position in a bed comprising the steps of:

a. placing a foot plate on the bed mattress;

b. joining a plurality of tubes to the foot plate;

c. sliding the first ends of a plurality of rods inside the respective tubes;

d. providing a plurality of L-shaped pieces having respective first and second legs;

e. pivotally connecting the second ends of the rods to the first legs of the respective L-shaped pieces;

f. placing the first legs of the L-shaped pieces against the foot portion of the bed frame; and g. clamping the second legs of the L-shaped pieces to the bed frame under the mattress.

* * * * *